US007234461B2

(12) United States Patent
Mix

(10) Patent No.: US 7,234,461 B2
(45) Date of Patent: Jun. 26, 2007

(54) ARCHING SNORKEL

(76) Inventor: John Mix, 700 Beaver Ct., Discovery Bay, CA (US) 94514

( * ) Notice: Subject to any disclaimer, the term of this patent is extended or adjusted under 35 U.S.C. 154(b) by 8 days.

(21) Appl. No.: 10/863,928

(22) Filed: Jun. 8, 2004

(65) Prior Publication Data

US 2005/0268906 A1 Dec. 8, 2005

(51) Int. Cl.
*B63C 11/16* (2006.01)
*B63C 11/02* (2006.01)

(52) U.S. Cl. ..... 128/201.11; 128/201.27

(58) Field of Classification Search ..... 128/201.11, 128/201.27, 204.26, 207.14, 201.26, 201.29, 128/201.28, 206.29; D24/110.5; 405/186, 405/187

See application file for complete search history.

(56) References Cited

U.S. PATENT DOCUMENTS 1,445,010 A * 2/1923 Feinberg ..... 128/201.11
1,539,733 A * 5/1925 Haskell ..... 128/201.11
3,140,551 A * 7/1964 Wayfield ..... 434/254
3,653,086 A * 4/1972 Gongwer ..... 2/9
D350,379 S * 9/1994 Kirchner ..... D24/110.5
5,671,728 A * 9/1997 Winefordner et al. . 128/201.11
D406,333 S * 3/1999 Garraffa ..... D24/110.5
6,073,626 A * 6/2000 Riffe ..... 128/201.11
6,318,363 B1 * 11/2001 Monnich ..... 128/201.11
6,668,822 B2 12/2003 Monnich ..... 128/210.11
2005/0051164 A1 * 3/2005 Hutter et al. ..... 128/201.11

* cited by examiner

*Primary Examiner*—Teena K. Mitchell
(74) *Attorney, Agent, or Firm*—James A. Gavney, Jr.

(57) ABSTRACT

A snorkel and snorkel system are disclosed. The snorkel includes an arching breathing tube with a mouthpiece at a first end and a breathing port at a second end. The arching breathing tube preferably arches through a range of angles between 240 and 300 degrees and mouthpiece and the breathing port are separated by a distance in a range of 8 to 16 inches. The snorkel system preferably includes a strap with a bracket for securing the snorkel to a user's head and along a front portion of the user's face.

15 Claims, 2 Drawing Sheets

ARCHING SNORKEL

FIELD OF THE INVENTION

This invention relates to swimming equipment. More particularly, the present invention relates to snorkels and snorkel systems for lap swimming in a pool.

BACKGROUND OF THE INVENTION

A number of conventional snorkel and snorkel systems are available. For example, there are a number of side-mounting snorkels that are configured to secure to a pair of goggles while snorkeling or swimming. These conventional or side-mounted snorkels are available with a number of simple or sophisticated mouthpieces and mechanisms to prevent the flow of water into the breathing tube of the snorkel.

Conventional or side-mounted snorkels provide a high degree of drag and are not well suited for swimming and lap training in a swimming pool. Accordingly, there is a continued need to develop snorkels and snorkel systems that are configured for swimming and lap training in a swimming pool.

SUMMARY OF THE INVENTION

A swimmer's technique needs to be perfected in order for the swimmer to be competitive. One training technique involves isolation of various aspects of swimming. With this training technique, a swimmer trains by concentrating on some aspect of swimming, while ignoring other aspects. For example, a swimmer uses a float board to practice kicking motion of the legs, while ignoring arm strokes. Likewise, the swimmer can train with a snorkel. Training with a snorkel allows the swimmer to focus on kicks and arm strokes without having to concentrate on breathing techniques, which requires the swimmer to turn his head and inhale while his mouth is out of the water. Further, swimming with a snorkel also allows the swimmer to become comfortable with his or her face submersed in the water for extended periods of time.

Conventional or side-mounted snorkels can interfere with the swimmers arm stroke and tend to provide too much drag through the water to allow for the accurate evaluation of a swimmers lap time. A front or center-mounted snorkel, such as illustrated by Garraffa in U.S. Pat. No. Des. 406,333 provides some improvements over the conventional or side-mounted snorkel for use in lap training. The front or center-mounted snorkel of Garraffa does not interfere with the swimmers arm stroke and has a streamlined breathing tube that reduces drag through the water.

During lap training, a swimmer usually performs a turn maneuver when he or she reaches a wall of the pool. A turn maneuver requires that the swimmer executes a forward tumble under the water with his body and head in a tucked position. After the swimmers head has cleared the wall of the pool and is facing in the opposite direction, the swimmer then pulls out of the tucked position and twists his body 180 degrees while simultaneously pushing off the wall of the swimming pool with his feet.

Both the conventional or side-mounted snorkel and the front or center-mounted snorkel of Garraffa, described above, are not well suited for lap training where turn maneuvers are practiced. On reason that these snorkels are not useful for lap training where turn maneuvers are practiced is because as the swimmer moves into the tucked position to begin the turn maneuver, his head is close to the wall of the pool. Accordingly, as the swimmer moves through the tumble, the snorkel can hit the side of the pool and disrupt the swimmer timing. A second reason that these snorkels are not useful for lap training where turn maneuvers are practiced is because as the swimmer goes through the tumble, the breathing tube of the snorkel tends to fill with water. Accordingly, after the turn maneuver is completed, the swimmer must clear the breathing tube of the snorkel, before he or she can resume breathing. Again, this can be disruptive to the swimmer's timing.

To address the aforementioned shortcomings, the present invention is directed to a snorkel and snorkel system suitable for lap swimming and training where turn maneuvers are practiced. The snorkel is preferably a center or front-mounted and low-profile snorkel that arches over the swimmer's head. In accordance with the embodiment of the invention, an arching breathing tube that arches over the swimmer's head prevents water from entering a breathing port of the snorkel while performing a turn maneuver, such as described above.

A snorkel, in accordance with the embodiments of the present invention, comprises an arching breathing tube with a mouthpiece attached to a first end and a breathing port positioned at a second end. In use, the arching breathing tube is configured to extend from the first end, arch over the top of the user's head and extend below a top portion of the user's head with the mouthpiece in the user's mouth. This helps to ensure that the swimmer keeps his or her head face down in the water.

The mouthpiece of the snorkel is preferably formed from silicone, rubber or any other soft resilient material that can be comfortably held in the user's mouth. The arching breathing tube is preferably formed from plastic that is injection molded as a single monolithic unit.

To achieve the aforementioned configuration, the arching breathing tube is bent or curved to arch through a range of angles between 240 and 300 degrees, and the mouthpiece and the breathing port are preferably separated by a distance in a range of 8 to 16 inches and more preferably by a distance in a range of 10 to 12 inches. The cross-section of the breathing tube can have any number of different geometries or combinations of geometries including, but not limited to, round, square, triangular, oval and the like. In accordance with a preferred embodiment to the invention, a first portion corresponding to the first end of the breathing tube is substantially round and tapers or flattens along a mid portion of the breathing tube to reduce resistance or drag through the water.

A system, in accordance with the embodiments of the invention, comprises a snorkel with an arching breathing tube and a mouthpiece, such as described above. The system further comprises means for securing the snorkel to a user's head. Preferably, the means for securing the snorkel to the user's head includes a head band or strap for wrapping around the user's head and a bracket coupled to the head band or strap for securing to the snorkel and holding the snorkel along a front portion of the user's face.

DETAILED DESCRIPTION OF THE INVENTION

Figure 1A:
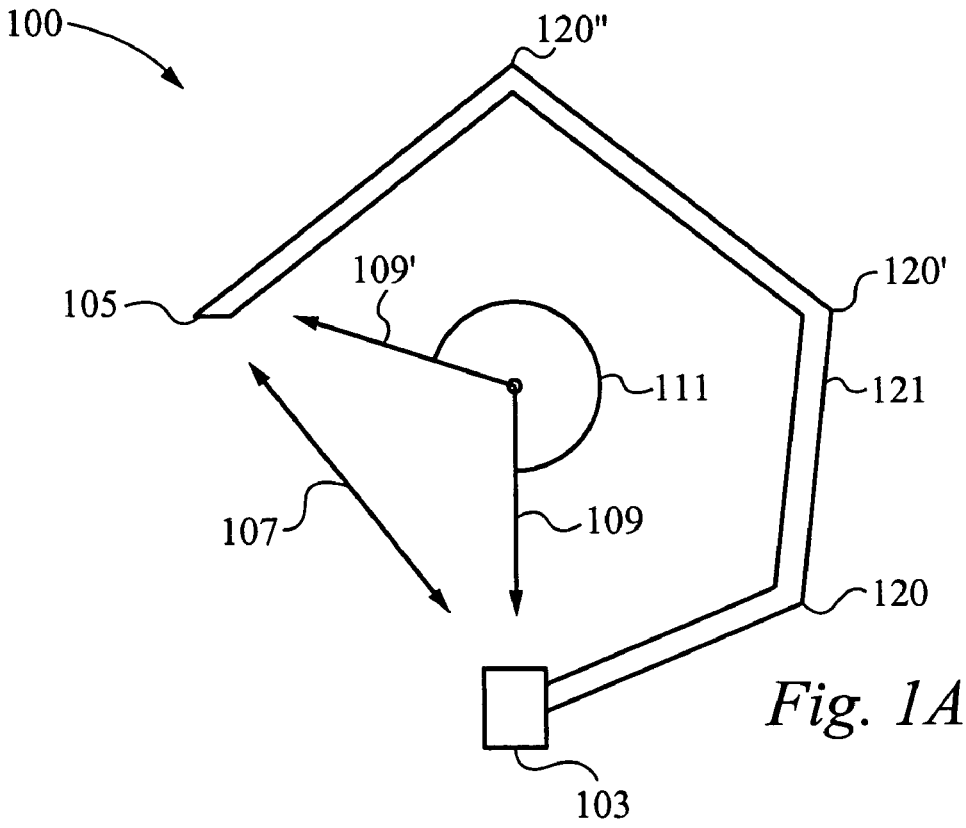
FIGS. 1A–B show schematic representations of arching snorkels, in accordance with the embodiments of the invention.

FIG. 1A shows a schematic representation of an arching snorkel 100, in accordance with the embodiments of the invention. The arching snorkel 100 includes an arching breathing tube 121 with a mouthpiece 103 coupled to a first end and a breathing port 105 positioned at a second end. The arching breathing tube 121 has a number of inflection points or bends 120, 120' and 120", such that the arching breathing tube 121 arches through a range of angles 111 between 240 and 300 degrees. The vectors or arrows 109 and 109' extend from a substantially central position within the arch formed by the arching breathing tube 121 and point to the first end and the second end of the arching breathing tube 121, respectively. The vectors or arrows 109 and 109' are provided to illustrate the range of angles 111. Alternatively, or in addition, arching through a range of angles 111 between 240 and 300 degrees, the breathing port 105 and the mouth piece 102 are separated by a distance in a range of 8 to 16 inches represented by the line 107.

Figure 1B:
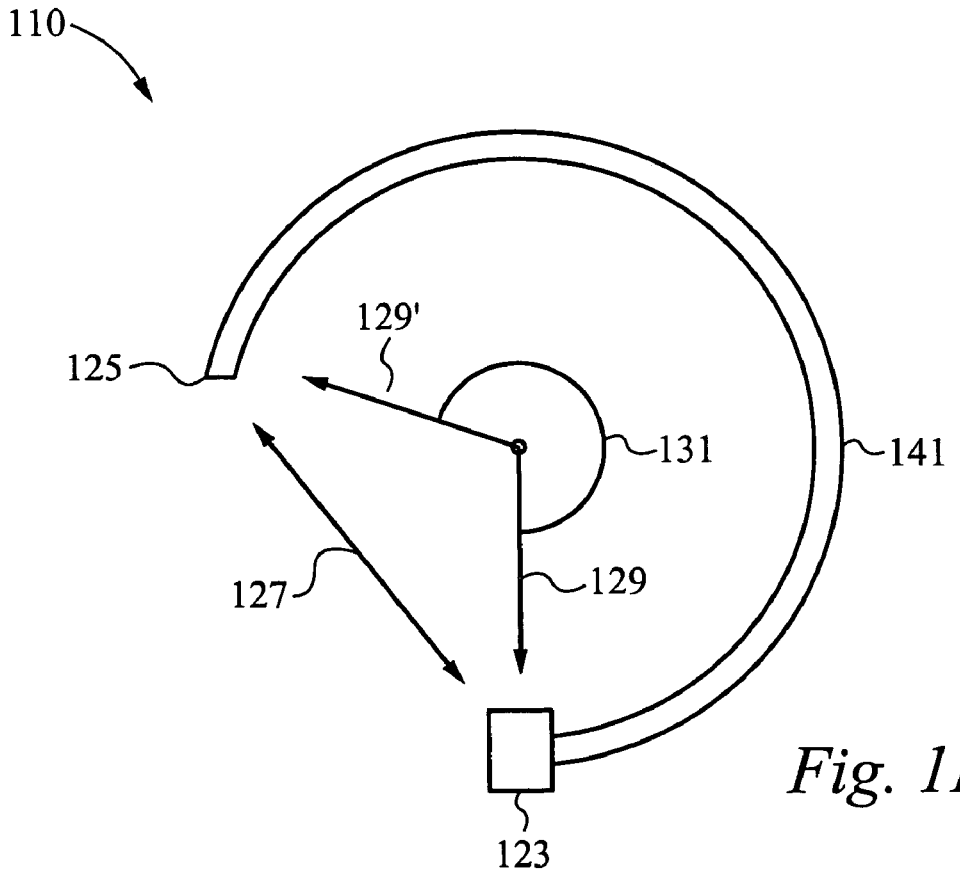

FIG. 1B shows a schematic representation of an arching snorkel 110, in accordance with further embodiments of the invention. The arching snorkel 110 includes an arching breathing tube 141 with a mouthpiece 123 coupled to a first end and a breathing port 125 positioned at a second end. The arching breathing tube 141 curves smoothly, such that the breathing tube 121 arches through a range of angles 131 between 240 and 300 degrees. The vectors or arrows 129 and 129' extend from a substantially central position within the arch formed by the arching breathing tube 141 and point to the first end and the second end of the arching breathing tube 121, respectively. The vectors or arrows 129 and 129' are provided to illustrate the range of angles 131. Alternatively, or in addition, to arching through the range of angles 131 between 240 and 300 degrees, the breathing port 125 and the mouth piece 123 are separated by a distance in a range of 8 to 16 inches represented by the line 127.

Figure 2:
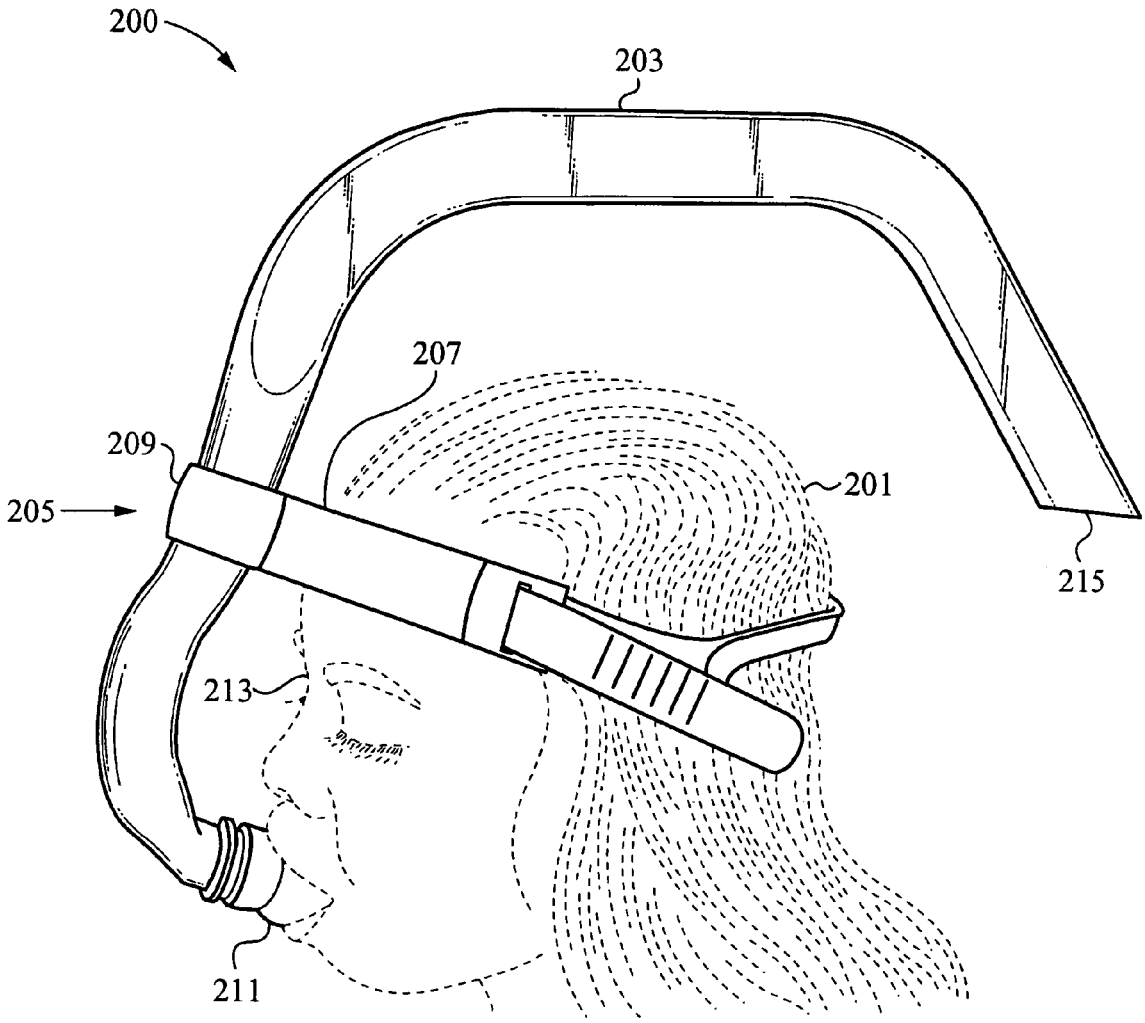
FIG. 2 shows an arching snorkel system, in accordance with the embodiments of the invention.

FIG. 2 shows an arching snorkel system 200, in accordance with a preferred embodiment of the invention. The arching snorkel system 200 includes an front mounted arching breathing tube 203 with a frontal mouthpiece 211 (i.e. is held in the user's mouth with the breathing tube extending along the front of the users face) that is coupled to a first end and a breathing port 215 positioned at a second end. The arching breathing tube 203 bends, such that the arching breathing tube 203 arches through a range of angles between 240 and 300 degrees and the frontal mouthpiece 211 and the and the breathing port 215 are separated by a distance in a range of 8 to 16 inches and preferably by a distance in a range of 10 to 12 inches Still referring to FIG. 2, the arching snorkel system 200 also includes means for securing 205 the arching breathing tube 203 to a user's head 201. Preferably, the means for securing 205 the arching breathing tube 203 to the user's head 201 includes a band or strap 207 for wrapping around the user's head 201 and a bracket 209 coupled to the strap 207 for securing to the arching breathing tube 203 along a front portion 213 of the user's head 201. In use, the arching breathing tube 203 extends along the front portion 213 of the user's head 201 with the frontal mouthpiece 211 held in the mouth of the user, and the arching breathing tube 203 arches over the user's head 201 and extends with the breathing port 215 below a top portion of the user's head 201, which helps to make sure that the user keeps the front portion 213 of his or her head 201 in the water while swimming.

The present invention provides a low-profile snorkel that is particularly useful for lap training in a swimming pool where turn maneuvers are performed by a swimmer. The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiment chosen for illustration without departing from the spirit and scope of the invention. For example, the cross-section of the arching breathing tube can have any number of different geometries or combinations of geometries and the arching breathing tube and mouthpiece can be formed from any number of different materials. The breathing tube can be formed in parts that are fitted or otherwise secured together and the breathing tube can rigid or flexible. Further, the mouth piece can have any number of different geometries or designs suitable for the application at hand. For example, the mouth piece can have a tubular portion that extends upward and connects with the breathing tube corresponding to the nose level of the user, eye level of the user or any position in between. The arching snorkel and snorkel system of the present invention can also include any number of different mechanisms to keep water out of the breathing tube.

What is claimed is:

1. A snorkel comprising:

a) a mouthpiece; and b) an arching breathing tube with the mouthpiece attached to a first end and a breathing port positioned at a second end, wherein the arching breathing tube is configured to extend from the first end in a user's mouth, arch over the user's head with the breathing port pointing downward, and extend below a top portion of the user's head with the mouthpiece engaged with the user's mouth, wherein the breathing port is substantially open such that water can readily flowing into the breathing tube and wherein the breathing tube tapers or flattens along a mid portion of the breathing tube and to the second end in order to reduce resistance or drag through the water.

2. The snorkel of claim 1, further comprising a mounting feature for coupling the arching breathing tube to the user's head.

3. The snorkel of claim 2, wherein the mounting feature comprises a headband and a bracket for coupling the arching breathing tube along a front portion of the user's head.

4. The snorkel of claim 1, wherein the arching breathing tube arches through a range of angles between 240 and 300 degrees.

5. The snorkel of claim 1, wherein mouthpiece and the breathing port are separated by a distance in a range of 8 to 16 inches.

6. An arching snorkel comprising a front mounting breathing tube with a frontal mouthpiece attached at a first end and an open breathing port located at a second end, wherein the frontal mouthpiece and the breathing port are separated by a distance in a range of 8 to 16 inches and, wherein the breathing tube tapers or flattens along a mid portion of the breathing tube and to the second end in order to reduce resistance or drag through the water.

7. The arching snorkel of claim 6, further comprising a mounting feature configured to couple the breathing tube along a front portion of a user's head.

8. The arching snorkel of claim 7, wherein the mounting feature comprises a head band configured to wrap around the user's head.

9. The arching snorkel of claim 6, wherein the breathing tube arches through a range of angles between 240 and 300 degrees.

10. An arching snorkel comprising:

a) a breathing tube that arches through a range of angles between 240 and 300 degrees with a first end and a second end wherein the breathing tube tapers or flattens along a mid portion of the breathing tube and to the second end in order to reduce resistance or drag through the water; and a mouthpiece attached to the first end of the breathing tube and a breathing port located at the second end of the breathing tube, wherein the second end is open such that water can flowing into the breathing tube when the second end is submersed in water and wherein the mouthpiece and the breathing port are separated by a distance in a range of 8 to 16 inches, wherein the breathing tube is configured to be secured along a front portion of a user's head and arch below a top portion of a user's head while at least a portion of the mouthpiece is in the user's mouth.

11. The arching snorkel of claim 10, further comprising a mounting feature for securing the breathing tube along the front portion of the user's head.

12. The arching snorkel of claim 10, wherein the breathing tube comprises plastic.

13. A snorkel system comprising:

a) an arching breathing tube with a mouthpiece attached to a first end and breathing port at a second end, the second end being open, such that water can readily flow into the breathing tube, when the breathing the is submersed in water and wherein the breathing tube tapers or flattens along a mid portion of the breathing tube and to the second end in order to reduce resistance or drag through the water; and b) a head band with a bracket for engaging the breathing tube, so that the breathing tube positioned at a front portion of a user's head and wherein the arching breathing tube is configured to arch over a back portion of the user's head with the breathing port below a top portion of the user's head while the mouthpiece engages the user's mouth.

14. The system of claim 13, wherein the arching breathing tube is formed from a single rigid piece of plastic.

15. A method of making a snorkel comprising:

a) molding hollow breathing tube with an open breathing port, wherein the breathing tube tapers or flattens along a mid portion of the breathing tube and to the open breathing port in order to reduce resistance or drag through the water; and b) coupling a frontal mouthpiece to the hollow breathing tube, wherein the frontal mouth piece and the breathing port are separated by a distance in a range of 8 to 16 inches and wherein the snorkel arched through a range of angles between 240 and 300 degrees.

* * * * *